US008197365B2

(12) United States Patent
Tokieda

(10) Patent No.: US 8,197,365 B2
(45) Date of Patent: Jun. 12, 2012

(54) BASEBALL OR SOFTBALL BAT, AND A MANUFACTURING METHOD THEREFOR

(75) Inventor: Kenichi Tokieda, Osaka (JP)

(73) Assignee: Zett Corporation, Osaka (JP)

( * ) Notice: Subject to any disclaimer, the term of this patent is extended or adjusted under 35 U.S.C. 154(b) by 99 days.

(21) Appl. No.: 12/524,644

(22) PCT Filed: Jan. 30, 2008

(86) PCT No.: PCT/JP2008/051385

§ 371 (c)(1),
(2), (4) Date: Jul. 27, 2009

(87) PCT Pub. No.: WO2008/093719

PCT Pub. Date: Aug. 7, 2008

(65) Prior Publication Data

US 2010/0113194 A1 May 6, 2010

(30) Foreign Application Priority Data

Feb. 2, 2007 (JP) ..... 2007-024466

(51) Int. Cl.
*A63B 59/06* (2006.01)

(52) U.S. Cl. ..... 473/566; 473/567

(58) Field of Classification Search ..... 473/457, 473/519, 520, 564–568
See application file for complete search history.

(56) References Cited

U.S. PATENT DOCUMENTS

| | | | | |
|---|---|---|---|---|
| 5,593,158 | A * | 1/1997 | Filice et al. | 473/520 |
| 6,485,382 | B1 * | 11/2002 | Chen | 473/566 |
| 6,511,392 | B1 * | 1/2003 | Chohan | 473/564 |
| 6,733,404 | B2 * | 5/2004 | Fritzke et al. | 473/566 |
| 6,824,482 | B1 * | 11/2004 | Tribble | 473/564 |
| 7,419,446 | B2 * | 9/2008 | Nguyen | 473/567 |
| 7,798,926 | B1 * | 9/2010 | Hsu | 473/566 |
| 2003/0158006 | A1 * | 8/2003 | Tribble | 473/564 |
| 2003/0186763 | A1 * | 10/2003 | Eggiman et al. | 473/564 |
| 2007/0155546 | A1 * | 7/2007 | Chauvin et al. | 473/520 |
| 2009/0264230 | A1 * | 10/2009 | Thouin | 473/567 |

FOREIGN PATENT DOCUMENTS

| | | | |
|---|---|---|---|
| JP | 6264571 | U | 4/1987 |
| JP | 04327866 | A | 11/1992 |
| JP | 2001190724 | A | 7/2001 |
| JP | 2002011130 | A | 1/2002 |
| JP | 2003299756 | A | 10/2003 |
| JP | 2004113557 | A | 4/2004 |

* cited by examiner

*Primary Examiner* — Mark Graham

(74) *Attorney, Agent, or Firm* — The Webb Law Firm

(57) ABSTRACT

An improvement is made effectively in the strength of a baseball or softball bat constructed by joining a ball-hitting member and a grip member formed of a Fiberglass Reinforced Plastic (FRP) material and a metal material, respectively.

In the baseball or softball bat constructed by joining a metal ball-hitting member and an FRP grip member, a joining end region of the grip member has an adhering piece bonded to one of an inner peripheral surface and an outer peripheral surface of a joined end region of the ball-hitting member, and a contact piece for contacting the other of the inner peripheral surface and the outer peripheral surface of the joined end region of the ball-hitting member when the adhering piece is in a bonded state.

15 Claims, 9 Drawing Sheets

BASEBALL OR SOFTBALL BAT, AND A MANUFACTURING METHOD THEREFOR

BACKGROUND OF THE INVENTION

1) Field of the Invention

This invention relates to a baseball or softball bat made by joining different materials, and a manufacturing method therefor. More particularly, the invention relates to a baseball or softball bat made by joining a ball-hitting member and a grip member formed, respectively of a Fiberglass Reinforced Plastic (FRP) material and a metal material, and a manufacturing method therefor.

2) Description of Related Art

A known baseball or softball bat of this type has a ball-hitting member and a grip member joined together, with a cylindrical joining end region of the grip member formed of an FRP material inserted into a cylindrical joined end region of the ball-hitting member formed of metal, and opposed surfaces thereof, i.e. an inner peripheral surface of the joined end region of the ball-hitting member and an outer peripheral surface of the joining end region of the grip member, bonded together by an adhesive (see Patent Document 1 below).

Patent Document 1: Japanese Unexamined Patent Publication No. 2003-299756

SUMMARY OF THE INVENTION

With the conventional baseball or softball bat noted above, the ball-hitting member formed of metal undergoes a very small amount of deflection. However, the ball-hitting member and grip member are joined only by bonding between the inner peripheral surface of the ball-hitting member and the outer peripheral surface of the grip member. Thus, when an impactive force is applied to the ball-hitting member at a time of hitting a ball, the ball-hitting member tends to tilt relative to the grip member in such a way that a portion adjacent the end surface (i.e. adjacent the grip member) of the joined end region of the ball-hitting member moves away from the outer peripheral surface of the grip member against the adhesive force of the adhesive.

Therefore, where the outer peripheral surface of the bat is painted, for example, the above tilting occurring at the time of hitting a ball creates a level difference adjacent the boundary between the ball-hitting member and grip member, which causes a problem of cracking the paint in the portion of level difference. In addition, the above tilting occurring at the time of hitting a ball causes a major bending deformation of the joining end region of the grip member formed of FRP. The major bending deformation poses a problem of damaging the grip member.

In view of this state of the art, a primary object of this invention is to solve the above problem effectively by a rational improvement in a junction structure of a ball-hitting member and a grip member.

A first characteristic construction of this invention relates to a baseball or softball bat.

A baseball or softball bat is constructed by joining a ball-hitting member made of metal and a grip member made of FRP, wherein a joining end region of the grip member has, formed integral therewith, an adhering piece bonded to one of an inner peripheral surface and an outer peripheral surface of a joined end region of the ball-hitting member, and a contact piece for contacting the other of the inner peripheral surface and the outer peripheral surface of the joined end region of the ball-hitting member when the adhering piece is in a bonded state.

According to this characteristic construction, in an adhering state of the adhering piece formed in the joining end region of the grip member, that is in a state of adhesion to the inner peripheral surface or outer peripheral surface (bonded surface) of the joined end region of the ball-hitting member, the contact piece formed in the joining end region of the grip member contacts an opposite surface of the bonded surface of the ball-hitting member. Therefore, the adhering piece and contact piece of the grip member constrain, by pinching from inside and outside, the joined end region of the ball-hitting member. This effectively inhibits tilting of the ball-hitting member relative to the grip member at a time of hitting a ball.

Therefore, even where the outer peripheral surface of the bat is painted, it is possible to inhibit effectively cracking of the paint occurring adjacent the boundary between the ball-hitting member and grip member at a time of hitting a ball. The amount of bending deformation at a time of hitting a ball of the joining end region of the grip member is reduced, thereby effectively inhibiting damage of the grip member occurring at a time of hitting a ball. These constitute a feature excellent in practical utility.

A second characteristic construction of this invention lies in that the adhering piece is bonded to the inner peripheral surface of the joined end region of the ball-hitting member.

That is, when manufacturing a baseball or softball bat made of FRP, for example, a pressing device such as a pressurizing tube is used to press, radially outward of the bat, a prepreg forming the FRP material when heated.

According to this characteristic construction, the grip member and ball-hitting member can be joined in the way that the adhering piece of the grip member is pressed against the inner peripheral surface of the joined end region of the ball-hitting member. Thus, the grip member and ball-hitting member can be joined by making good use of an existing pressing device such as the pressurizing tube. It is therefore possible to reduce manufacturing cost.

A third characteristic construction of this invention lies in that the contact piece is bonded to the outer peripheral surface of the joined end region of the ball-hitting member.

According to this characteristic construction, both the contact piece and adhering piece formed in the joining end region of the grip member are bonded to both the outer peripheral surface and inner peripheral surface of the joined end region of the ball-hitting member. This secures a large area of bonding between the ball-hitting member and grip member to increase adhering strength of the ball-hitting member and grip member. Therefore, tilting of the ball-hitting member relative to the grip member at a time of hitting a ball can be inhibited with increased effect.

A fourth characteristic construction of this invention lies in that the joined end region of the ball-hitting member is formed progressively thinner toward a proximal end of the bat, in such a manner that the inner peripheral surface shifts toward the outer peripheral surface as it extends toward the proximal end of the bat.

According to this characteristic construction, while inhibiting an increase in the mass of the entire bat as much as possible, the grip member made of FRP has the mass of the FRP material increased in a way that increases mass progressively toward the proximal end of the joining end region. Therefore, the strength of the joining end region of the grip member is effectively improved to inhibit damage of the grip member at a time of hitting a ball with increased effect.

A fifth characteristic construction of this invention lies in that the joined end region of the ball-hitting member has an end surface thereof formed to have a sloping surface shape, with the more radially outward position thereof located the closer to a distal end of the bat.

According to this characteristic construction, while forming on the grip member the contact piece for contacting the outer peripheral surface of the joined end region of the ball-hitting member, the thickness of the proximal part (adjacent the proximal end of the bat) of the contact piece corresponding to the end surface of the joined end region of the ball-hitting member can be made as large as possible. At the same time, it can also make gentle the bending angle of the inner peripheral surface of the proximal part of the contact piece. Therefore, the strength of the contact piece can be increased effectively.

A sixth characteristic construction of this invention lies in that the joined end region of the ball-hitting member has, formed thereon, a receiving portion for the contact piece where the outer peripheral surface is reduced radially inwardly of the bat.

According to this characteristic construction, a level difference, and more particularly a level difference in the form of a projection of the grip member, occurring on the outer peripheral surface of a part of transition from the ball-hitting member to the grip member in the state of the bat being joined can be inhibited, or the level difference can be made small. For that matter, an impactive force occurring at a time of hitting a ball with the part of transition from the ball-hitting member to the grip member can be distributed effectively to the ball-hitting member and grip member. It is therefore possible to inhibit the impactive force at a time of hitting a ball being intensively transmitted to the grip member, to inhibit damage of the grip member at a time of hitting a ball with increased effect.

A seventh characteristic construction of this invention lies in that the receiving portion is arranged to form a space from an end surface of the contact piece when the bat is in a joined state.

According to this characteristic construction, it is possible to prevent the end surface of the contact piece from contacting part (e.g. the end surface) of the receiving portion when the bat is in the joined state. It is therefore possible to inhibit effectively the trouble of an impactive force being transmitted from part of the receiving portion directly to the end surface of the contact piece at a time of hitting a ball.

Compared with the case where the receiving portion is constructed without forming a space with the end surface of the contact piece in the joined state of the bat, manufacturing accuracy can be lowered at the time of manufacture. Therefore, manufacturing cost can also be reduced.

An eighth characteristic construction of this invention lies in that the contact piece is formed to have a thickness of 0.1 mm to 1.0 mm.

That is, an ordinary baseball or softball bat is used for at least one year or more. Then, experiments have been conducted by changing the thickness of the contact piece. It has been found that, where the thickness of the contact piece is less than 0.1 mm, a continued use for less than one year results in damage to the grip member (a paint surface adjacent the boundary between the ball-hitting member and grip member in the case where finish paint is applied to the peripheral surface of the bat). It has also been found that, where the thickness of the contact piece exceeds 1 mm, although the material manufacture increases in quantity, the period taken until damage is done to the grip member does not change significantly. Based on these findings, the baseball or softball bat acquires practical use strength effectively with the contact piece formed to have the thickness of 0.1 mm to 1.0 mm according to this characteristic construction.

A ninth characteristic construction of this invention relates to a method of manufacturing a baseball or softball bat.

A method of manufacturing the baseball or softball bat described in the third characteristic construction, comprises:

assembling a bat molding member by placing the joined end region of the ball-hitting member between an inner molding member and an outer molding member which form the grip member when heated, and subsequently heating the bat molding member with a bat forming metallic mold in a state in which a first pressing device presses the inner molding member against the inner peripheral surface of the ball-hitting member, and in a state in which a second pressing device presses the outer molding member against the outer peripheral surface of the ball-hitting member.

It is conceivable to employ the following manufacturing method, for example, for manufacturing the baseball or softball bat in which the adhering piece formed integral with the joining end region of the grip member is bonded to the inner peripheral surface of the joined end region of the ball-hitting member, and the contact piece formed integral with the joining end region of the grip member is bonded to the outer peripheral surface of the joined end region of the ball-hitting member.

That is, a bat molding member is assembled by placing the joined end region of the ball-hitting member between an inner molding member and an outer molding member, and subsequently a pressing device presses the inner molding member against the inner peripheral surface of the ball-hitting member, whereby the outer molding member also is pressed against the outer peripheral surface of the ball-hitting member in a mode of the outer molding member being pressed between the outer peripheral surface of the ball-hitting member and an inner peripheral surface of a metallic mold.

However, with this manufacturing method, the outer molding member cannot be pressed against the outer peripheral surface of the ball-hitting member with a sufficient pressing force, since the pressing force of the pressing device is caught by the metallic ball-hitting member disposed between the inner molding member and outer molding member. Therefore, although it is possible to obtain the strength of the inner molding member and adhesion of the inner molding member and ball-hitting member, it is impossible to fully obtain the strength of the outer molding member and adhesion of the outer molding member and ball-hitting member.

On the other hand, according to this characteristic construction, the first pressing device presses the inner molding member against the inner peripheral surface of the ball-hitting member with a predetermined pressing force, and the second pressing device presses the outer molding member against the outer peripheral surface of the ball-hitting member with a predetermined pressing force. It is therefore possible to obtain the strength of the inner molding member and adhesion of the inner molding member and ball-hitting member, and to fully obtain the strength of the outer molding member and adhesion of the outer molding member and ball-hitting member.

A tenth characteristic construction of this invention lies in that an expandable member expandable by heating is placed as the second pressing member between the outer molding member and the bat forming metallic mold.

According to this characteristic construction, when the bat molding member is heated by the metallic mold, the expandable member will expand automatically inward of the metallic mold (i.e. toward the outer molding member). The expansion of the expandable member can automatically press the outer molding member against the outer peripheral surface of the ball-hitting member. This simplifies the manufacturing operation.

An eleventh characteristic construction of this invention lies in that a radially shrinkable member radially shrinkable by heating is placed around the outer molding member.

According to this characteristic construction, when the bat molding member is heated by the bat forming metallic mold, the radially shrinkable member placed around the outer molding member will shrink. The shrinking of the shrinkable member can automatically press the outer molding member against the outer peripheral surface of the ball-hitting member in the form of squeezing the outer peripheral surface of the outer molding member. This simplifies the manufacturing operation.

An existing bat forming metallic mold (i.e. a metallic mold for forming a baseball or softball made of FRP) can be utilized as it is. Therefore, compared with the case of newly manufacturing or purchasing a bat forming metallic mold with the second pressing device assembled thereto, manufacturing cost can be reduced.

A twelfth characteristic construction of this invention lies in that the expandable member is placed beforehand on a part of the bat forming metallic mold opposed to the outer molding member.

According to this characteristic construction, the manufacturing process can exclude an operation for placing the expandable member between the outer molding member and bat forming metallic mold. Therefore, the manufacturing process can be shortened.

A thirteenth characteristic construction of this invention relates to a method of manufacturing a baseball or softball bat.

A method of manufacturing a baseball or softball bat in which the ball-hitting member of the baseball or softball bat described in the third characteristic construction has, inserted therein, a ball-hitting tube made of FRP, comprises:

assembling a bat molding member by placing the joined end region of the ball-hitting member between an inner molding member and an outer molding member which form the grip member when heated, and placing in the ball-hitting member a tube molding member for forming the ball-hitting tube when heated, and subsequently heating the bat molding member with a bat forming metallic mold in a state in which a first pressing device presses the inner molding member and the tube molding member against the inner peripheral surface of the ball-hitting member, and in a state in which a second pressing device presses the outer molding member against the outer peripheral surface of the ball-hitting member.

That is, it is known that a ball-hitting tube made of FRP and fitted in the ball-hitting portion of a baseball or softball bat wall increase strength and lead to lightness. According to this characteristic construction, the first pressing device for pressing the inner molding member on the inner peripheral surface of the ball-hitting member presses the tube molding member on the inner peripheral surface of the ball-hitting member. Therefore, without adding a pressing device or pressing step for exclusive use in pressing the tube molding member on the inner peripheral surface of the ball-hitting member, it is possible to manufacture the baseball or softball having the ball-hitting tube fitted in the ball-hitting member in addition to joining the ball-hitting member made of metal and the grip member made of FRP.

A fourteenth characteristic construction of this invention lies in that, before heating the bat molding member with the metallic mold, an adhesion preventive member is interposed between the tube molding member and the ball-hitting member for preventing adhesion of the tube molding member and the ball-hitting member, or an adhesion inhibitor is applied to an outer peripheral surface of the tube molding member or an inner peripheral surface of the ball-hitting member.

That is, it is known that, where the ball-hitting tube made of FRP is fitted in the ball-hitting member, an increased repulsive force will act on a ball if the ball-hitting member and ball-hitting tube are not bonded together. According to this characteristic construction, without adding a pressing device or pressing step for exclusive use in pressing the tube molding member on the inner peripheral surface of the ball-hitting member, it is possible to manufacture the baseball or softball having the ball-hitting tube fitted in and not bonded to the ball-hitting member in addition to joining the ball-hitting member made of metal and the grip member made of FRP.

A fifteenth characteristic construction of this invention relates to a baseball or softball bat, and its characteristic lies in a baseball or softball bat constructed by joining a ball-hitting member made of FRP and a grip member made of metal, wherein a joining end region of the ball-hitting member has, formed integral therewith, an adhering piece bonded to one of an inner peripheral surface and an outer peripheral surface of a joined end region of the grip member, and a contact portion for contacting the other of the inner peripheral surface and the outer peripheral surface of the joined end region of the grip member when the adhering piece is in a bonded state.

According to this characteristic construction, as in the first characteristic construction, the adhering piece and contact piece of the ball-hitting member made of FRP constrain, by pinching the joined end region of the grip member made of metal. This effectively inhibits tilting of the grip member relative to the ball-hitting member at a time of hitting a ball.

DETAILED DESCRIPTION OF THE PREFERRED EMBODIMENTS

First Embodiment

Figure 1:
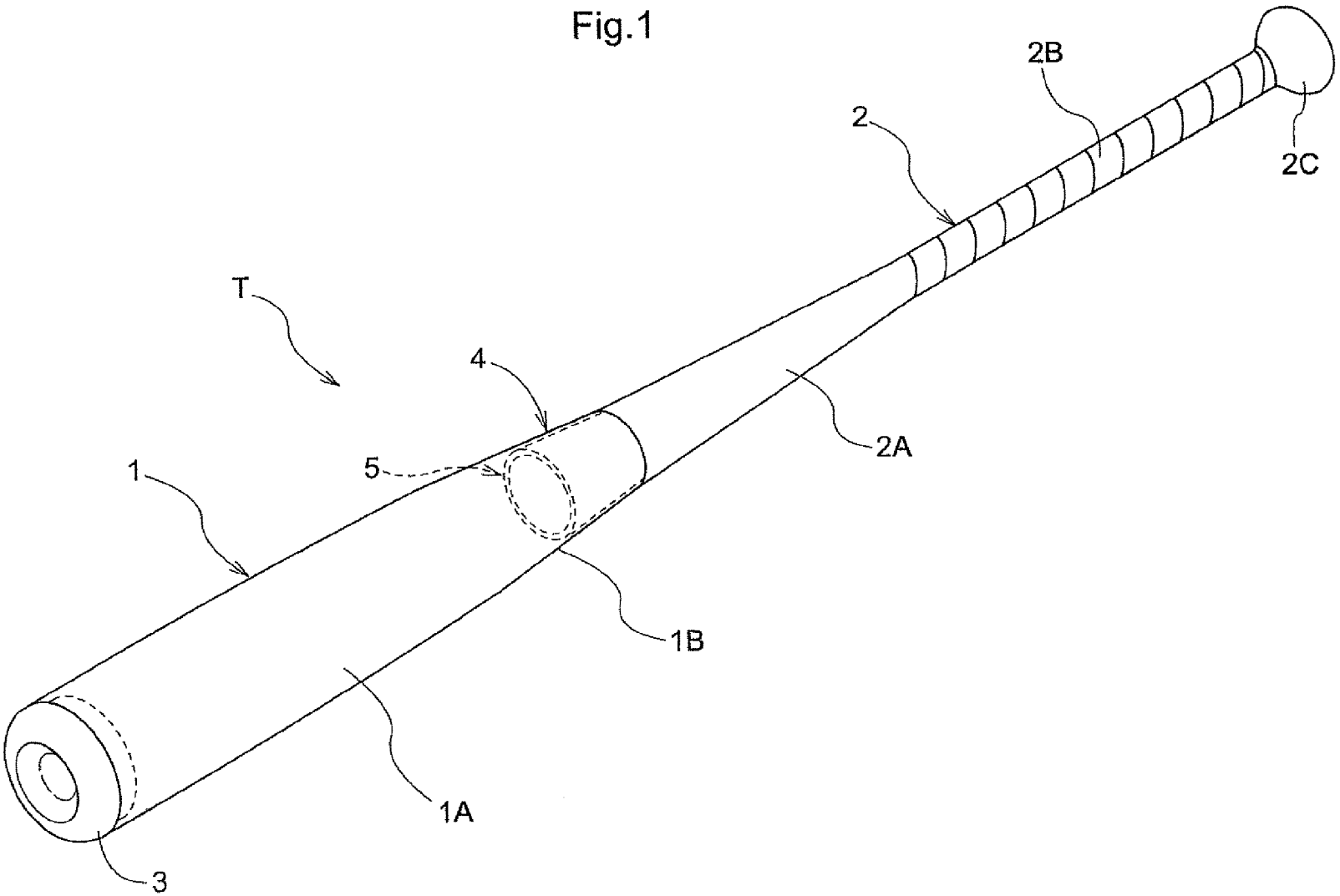
FIG. 1 is a perspective view showing a first embodiment of baseball or softball bat.
Figure 2:
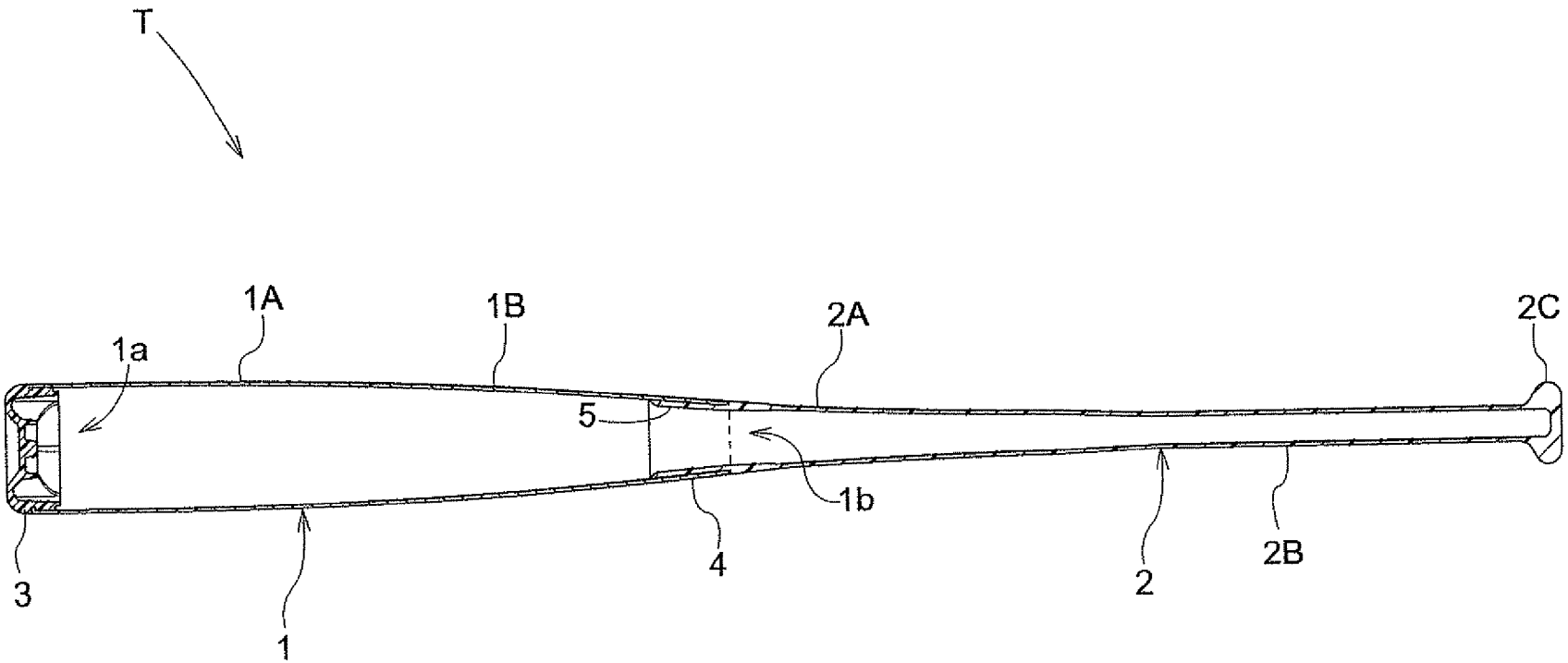
FIG. 2 is a sectional side view showing the first embodiment of baseball softball bat.

FIGS. 1 and 2 show a baseball or softball bat T according to this invention. Numeral 1 is a ball-hitting member forming a distal portion of the bat and formed of metal (an aluminum alloy in this embodiment), and a grip member forming a proximal portion of the bat and formed of FRP. An end cap 3 is attached to the tip end of the ball-hitting member 1 for closing an end opening 1*a*.

The ball-hitting member 1 is in the form approximately of a tapered cylinder, and includes a cylindrical ball-hitting portion 1A adjacent the distal end of the bat, and a converging portion 1B of the shape of a truncated cone pipe adjacent the proximal end of the bat. On the other hand, the grip member 2 is in the form approximately of a flared cylinder, and includes a flared portion 2A of the shape of a truncated cone pipe adjacent the distal end of the bat, a grip end portion 2C adjacent the proximal end of the bat, and a grip portion 2B of the shape of a thin cylinder therebetween.

The bat T is constructed by joining a region adjacent the proximal end of the bat (joined end region) 4 of the convergence portion 1B of the ball-hitting member 1 and a region adjacent the distal end of the bat (joining end region) 5 of the flared portion 2A of the grip member 2.

Figure 3:
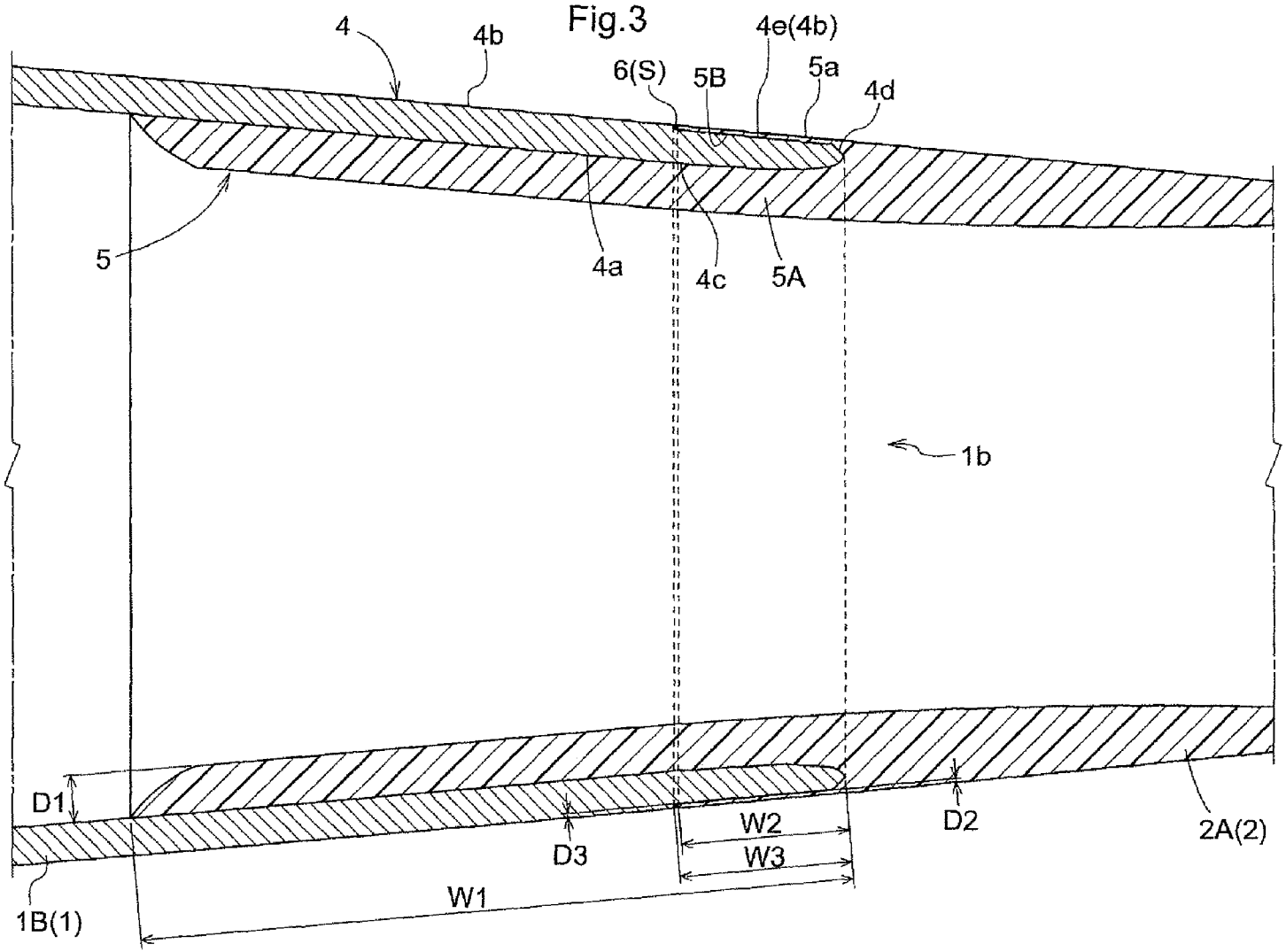
FIG. 3 is a sectional side view of a principal part in the first embodiment of baseball or softball bat.
Figure 4:
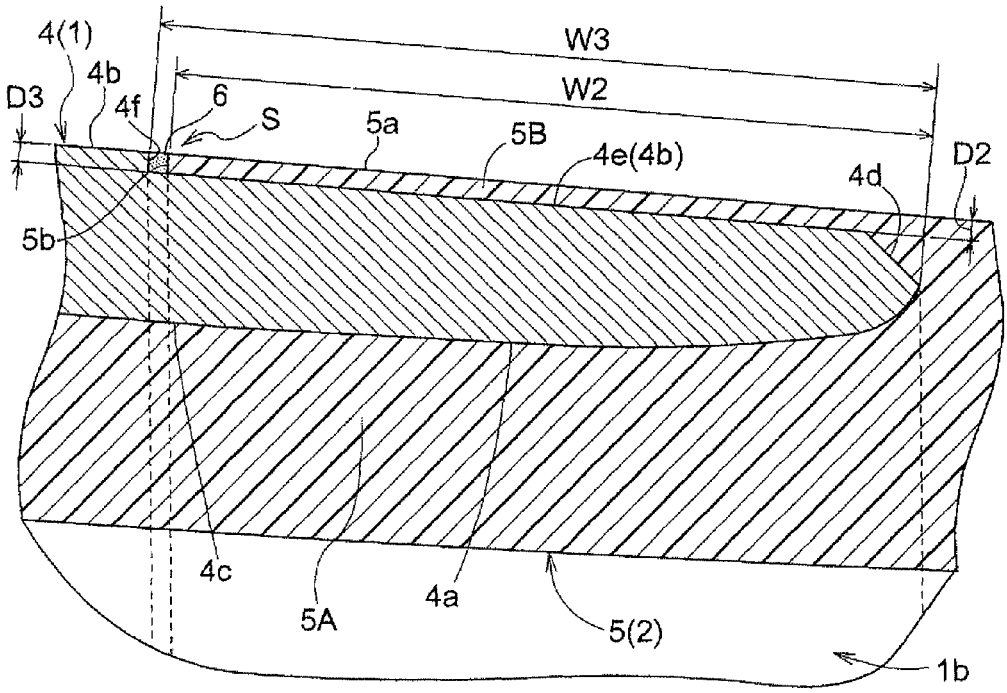
FIG. 4 is a sectional side view of a principal part in the first embodiment of baseball or softball bat.

As shown in FIGS. 3 and 4, the joining end region 5 of the grip member 2 has, formed integral therewith, a cylindrical adhering piece 5A bonded in circumferential contact (face-bonded in this embodiment) to an inner peripheral surface 4*a* of the joined end region 4 of the ball-hitting member 1. The joining end region 5 has, formed integral therewith, also a cylindrical contact piece 5B for contacting in circumferential contact (face contact in this embodiment) with an outer peripheral surface 4*b* of the joined end region 4 of the ball-hitting member 1 when the adhering piece 5A is in the bonded state.

Therefore, the adhering piece 5A and contact piece 5B of the grip member 2 constrain, by pinching from inside and outside, the joined end region 4 of the ball-hitting member 1. This effectively inhibits tilting (or a change in position) of the joined end region 4 of the ball-hitting member 1 relative to the joining end region 5 of the grip member 2 at a time of hitting a ball.

In this embodiment, the contact piece 5B also is bonded in circumferential contact to the outer peripheral surface 4*b* of the joined end region 4 of the ball-hitting member 1. Therefore, both the adhering piece 5A and contact piece 5B pinch therebetween the joined end region 4 of the ball-hitting member 1 (more particularly, the adhering piece 5A, the contact piece 5B and a connection thereof envelop the joined end region 4 of the ball-hitting member 1 from three directions), thereby securing a large area of bonding between the ball-hitting member 1 and grip member 2.

The length W1 of the adhering piece 5A in the longitudinal direction of the bat, preferably, is in a range of 30 mm to 120 mm, and in this embodiment, its length is about 70 mm. The thickness D1 of the adhering piece 5A, preferably, is in a range of 1 mm to 10 mm, and in this embodiment, its thickness is about 2.5 mm.

On the other hand, the length W2 of the contact piece 5B in the longitudinal direction of the bat, preferably, is in a range of 3 mm to 40 mm, and in this embodiment, its length is about 10 mm. The thickness D2 of the contact piece 5B, preferably, is in a range of 0.1 mm to 1.0 mm, more desirably, in a range of 0.2 mm to 0.6 mm, and in this embodiment, its thickness is about 0.4 mm.

That is, an ordinary baseball or softball bat is used for at least one year or more. Then, experiments have been conducted by changing the thickness of contact piece 5B. It has been found that, where the thickness D2 of the contact piece 5B is less than 0.1 mm, a continued use for less than one year results in damage to the grip member 2 (a paint surface adjacent the boundary between the ball-hitting member 1 and grip member 2 in the case where finish paint is applied to the peripheral surface of the bat T). It has also been found that, where the thickness D2 of the contact piece 5B exceeds 1 mm, although the material manufacture increases in quantity, the period taken until damage is done to the grip member 2 does not change significantly. Based on the above findings, the baseball or softball bat T acquires practical use strength effectively with the thickness D2 of the contact piece 5B set to the above thickness.

Figure 5:
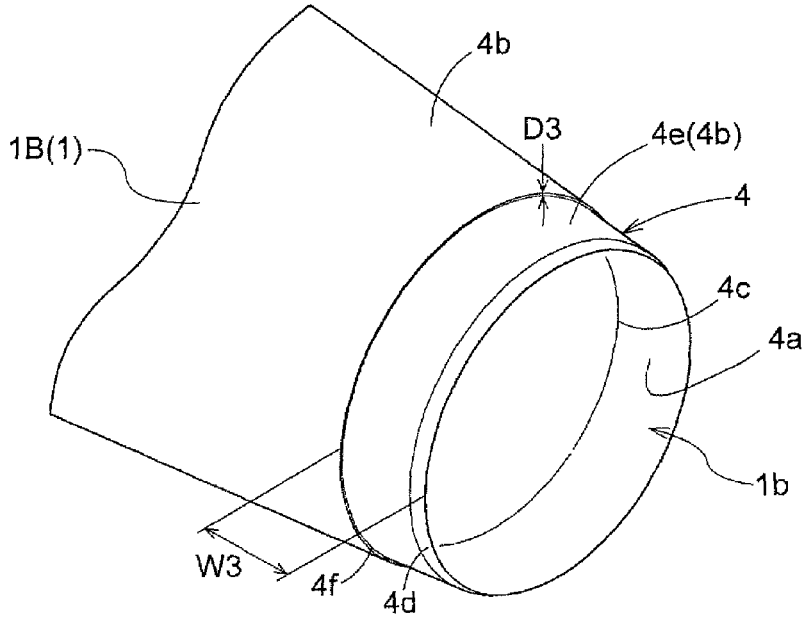
FIG. 5 is an explanatory perspective view of a principal part of a ball-hitting member in the first embodiment of baseball or softball bat.

As shown in FIGS. 3-5, the joined end region 4 of the ball-hitting member 1 is formed progressively thinner toward the proximal end of the bat, in such a manner that the inner peripheral, surface 4*a*, with a shift starting point located at a boundary 4*c*, shifts toward the outer peripheral surface 4*b* as it extends toward the proximal end of the bat. Therefore, while inhibiting an increase in the mass of the entire bat as much as possible, the mass of the FRP material in the joining end region 5 of the grip member 2 is secured to be larger toward its proximal end corresponding to the end surface of the ball-hitting member 1.

The boundary 4*c* is formed to have a smooth curved surface shape. This inhibits as much as possible the boundary 4*c* from applying a local impactive force to the outer peripheral surface of the joining end region 5 of the grip member 2 at a time of hitting a ball.

An end surface 4*d* of the joined end region 4 of the ball-hitting member 1 is formed to have a sloping surface shape, with the more radially outward position thereof located the closer to the distal end of the bat. This secures a maximal thickness of the proximal part (i.e. the part adjacent the proximal end of the bat) of the contact piece 5B of the grip member 2, and makes the bending angle of the proximal part of the inner peripheral surface of the contact piece 5B as gentle as possible.

Further, the joined end region 4 of the ball-hitting member 1 has, formed thereon, an annular receiving portion 4*e* for the contact piece 5B where the outer peripheral surface 4*b* is reduced radially inwardly of the bat. This effectively inhibits a level difference occurring on the outer peripheral surface of a part ranging from the ball-hitting member 1 to the grip member 2.

Specifically, the depth D3 of the receiving portion 4*e* corresponds to the thickness of the contact piece 5B. The length W3 of the receiving portion 4*e* in the longitudinal direction of the bat is set to form a space S between an end surface 5*b* of the contact piece 5B and an end surface 4*f* of the receiving portion 4*e* when the bat is in a joined state. In this embodiment, the length W3 of the receiving portion 4*e* in the longitudinal direction of the bat is 12 mm while the length W2 of the contact piece 5B in the longitudinal direction of the bat is 10 mm.

Numeral 6 is a putty material embedded in the space S to finish smoothly the junction of the ball-hitting member 1 and grip member 2.

That is, the space S (specifically, the putty material 6) between the end surface 5*b* of the contact piece 5B and end surface 4*f* of the receiving portion 4*e* inhibits transmission of an impactive force from the cliff surface 4*f* of the receiving portion 4*e* to the end surface 5*b* of the contact piece 5B at a time of hitting a ball, and secures the largest possible tolerance for manufacturing accuracy at the time of manufacture.

Next, a method of manufacturing the bat T having the above construction will be described.

(a) Forming the Ball-Hitting Member 1 (not Shown)

First, after forming an aluminum alloy pipe by swaging process, heat treatment is carried out to secure strength. Then, a longitudinal polishing process, an alumite process and a finish printing process is carried out on the outer peripheral surface of the aluminum alloy pipe.

Next, the portion of the aluminum alloy pipe to which the grip member 2 is to be joined is ground. After removing only from this portion aluminum oxide coating applied by the alumite process, a chipping process is carried out on this portion to form the joined end region end 4. The above steps complete formation of the ball-hitting member 1.

(b) Forming an Inner Molding Member 8 to Serve as the Grip Member 2

Figure 6:
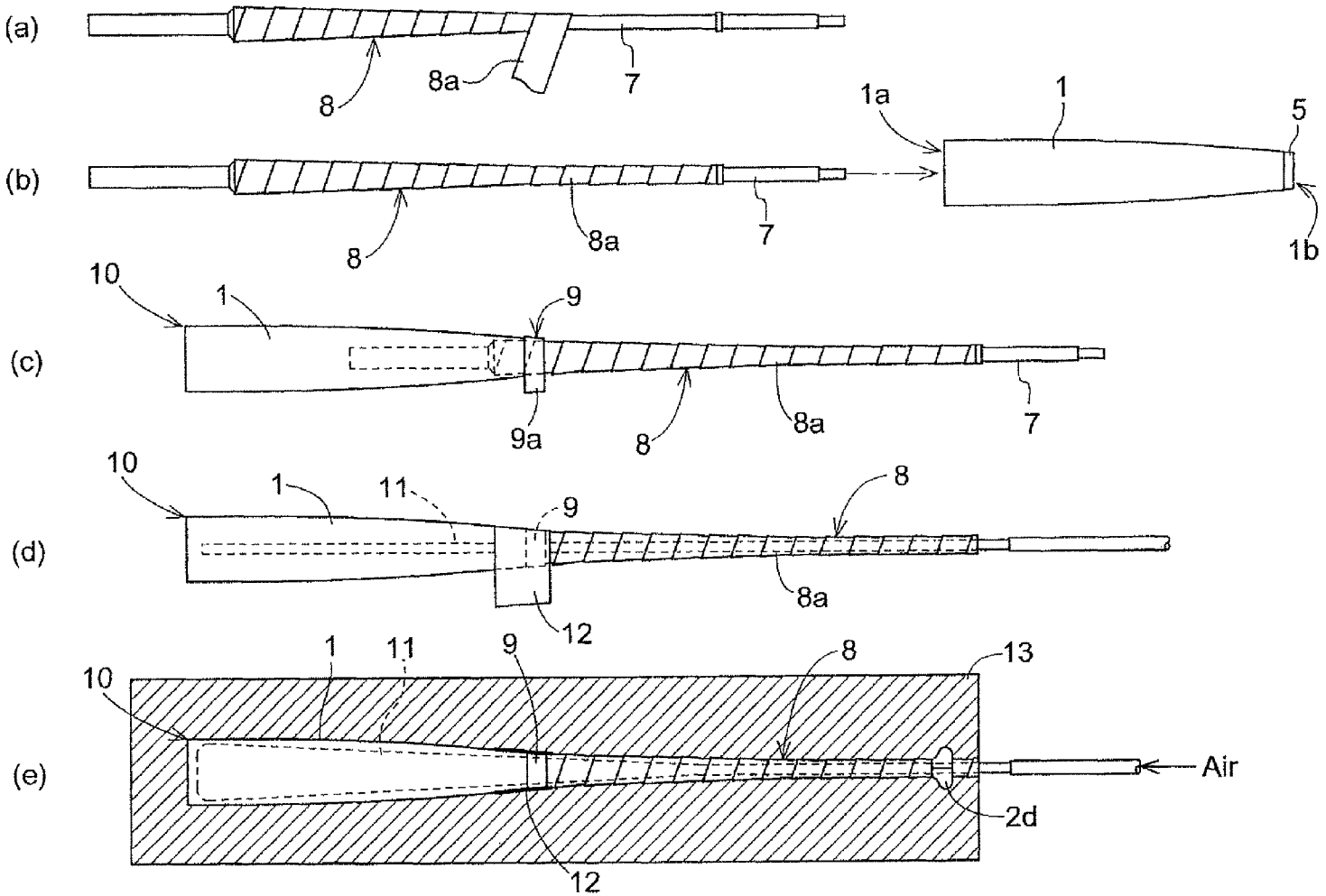
FIG. 6 is an explanatory view showing a manufacturing method in the first embodiment of baseball or softball bat.

As shown in FIG. 6 (*a*), a prepreg 8*a* to form the FRP material when heated is wrapped in laminated state around a mandrel 7, to form an inner molding member 8 serving as the grip member 2.

(c) Assembling a Bat Molding Member 10

A commercially available adhesion aiding tape (not shown) which improves adhesion of FRP and metal is wrapped around the part to be attached to the ball-hitting member 1 of the outer peripheral surface of the inner molding member 8 formed in step (b) above (i.e. the part corresponding to the adhering piece 5 of the grip member 2). Subsequently, as shown in FIG. 6 (*b*), the inner molding member 8 is inserted into the ball-hitting member 1 from the distal end opening 1*a* of the ball-hitting member 1, in a state of drawing a part of the inner molding member 8 adjacent the proximal end of the bat out of the proximal end opening 1*b* of the ball-hitting member 1. The inner molding member 8 and ball-hitting member 1 are arranged in a predetermined relative position (in this embodiment, a position where the part of the inner molding member 8 adjacent the distal end of the bat is caught by the part of the ball-hitting member 1 adjacent the proximal end of the bat).

Next, an adhesion aiding tape (not shown) similar to the one noted above is wrapped around the outer peripheral surfaces of the inner molding member 8 and ball-hitting member 1, in a state of covering the boundary between the inner molding member 8 and ball-hitting member 1. Subsequently, as shown in FIG. 6 (*c*), an FRP sheet 9*a* is wrapped around the outer peripheral surface of the adhesion aiding tape to form an outer molding member 9 serving as the grip member 2. The above steps complete assembly of the bat molding member 10.

(d) Forming the Bat T

As shown in FIG. 6 (*d*), a pressurizing tube 11 expandable by air pressure (or hydraulic pressure) is inserted in replacement of the mandrel 7 into the bat molding member 10 assembled in step (c) above. A heat-shrinkable tape 12 having heat shrinkability (an example of radially shrinkable member radially shrinkable by heating) is wrapped around the outer peripheral surface of the outer molding member 9.

The heat-shrinkable tape 12 is in the form of a biaxially oriented polypropylene film about 30 μm thick. The heat-shrinkable tape 12 has the following properties. Each measurement is based on Japanese Industrial Standards (common name: JIS standards).

contraction percentage in the lengthwise direction (longitudinal direction of the tape): about 2.5% (heated at 120° C. for 15 minutes)

contraction percentage in the transverse direction (width direction of the tape): about 0.3% (heated at 120° C. for 15 minutes)

tensile strength in the lengthwise direction: about 19.1 $kg/mm^2$ tensile strength in the transverse direction: about 26.6 $kg/mm^2$ elongation percentage in the lengthwise direction: about 103% elongation percentage in the transverse direction: about 57%

Next, as shown in FIG. 6 (*e*), the bat molding member 10 with the pressurizing tube 11 and heat-shrinkable tape 12 attached thereto is placed in a bat forming metallic mold 13 (e.g. an existing metallic mold for forming FRP bats), a knob 14 formed of FRP is attached, and the metallic mold 13 is closed. Then, the pressurizing tube 11 is expanded, and the bat molding member 10 is heated in a state of the pressurizing tube 11 pressing the inner molding member 8 against the inner peripheral surface 4*a* of the joined end region 4 of the ball-hitting member 1 and the inner peripheral surface of the metallic mold 13.

The heating action of the metallic mold 13 causes the heat-shrinkable tape 12 wrapped around the outer peripheral surface of the outer molding member 9 to shrink radially at this time. Consequently, the outer molding member 9 is pressed against the outer peripheral surface 4*b* of the joined end region 4 of the ball-hitting member 1, as the outer molding member 9 squeezes the outer molding member 9.

Then, the bat molding member 10 formed integral by heating is taken out of the metallic mold 13. The outer peripheral surface of the bat molding member 10 is put to finishing processes such as polish, putty process, printing and painting. Subsequently, a step of attaching the end cap 3 and a step of wrapping leather around the grip portion 2B to complete formation of the bat T.

Thus, this manufacturing method, with the pressing force of each of the pressurizing tube 11 and heat-shrinkable tape 12, can effectively obtain a predetermined adhesive strength between the outer peripheral surface of the inner molding member 8 and the inner peripheral surface of the ball-hitting member 1, and between the inner peripheral surface of the outer molding member 9 and the outer peripheral surface of the ball-hitting member 1. Moreover, the existing bat forming metallic mold 13 can be utilized as it is, to achieve also a reduction in manufacturing cost effectively.

In this embodiment, the pressurizing tube 11 corresponds to the first pressing device for pressing the inner molding member 8 against the inner peripheral surface of the ball-hitting member 1. The heat-shrinkable tape 12 corresponds to the second pressing device for pressing the outer molding member 9 against the outer peripheral surface of the ball-hitting member 1.

Second Embodiment

The first embodiment described above shows the case where a heat-shrinkable tape 12 having heat shrinkability which is one example of radially shrinkable member radially shrinkable when heated is wrapped around the outer molding member 9 as the second pressing device. Instead, as shown in FIG. 7 (*a*), a pad 18 made of silicon rubber which is heat-expandable and which is an example of expandable member may be placed (assembled in the illustrated example) beforehand on the inner peripheral surface of the metallic mold 19 as the second pressing device.

Figure 7:
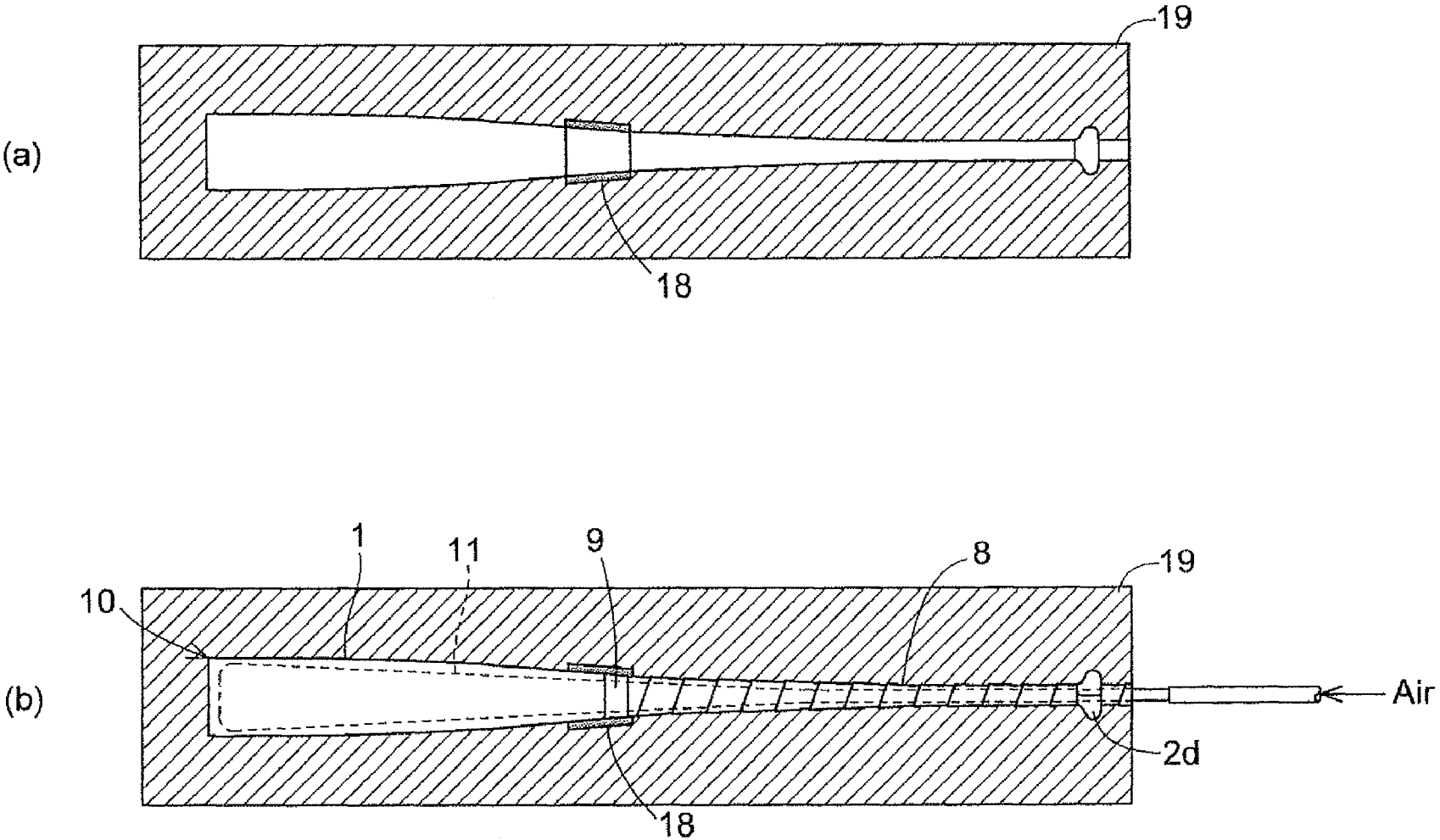
FIG. 7 is an explanatory view showing a manufacturing method in a second embodiment of baseball or softball bat.

In this case, in the process of manufacturing the baseball or softball bat T, as shown in FIG. 7 (*b*), the bat molding member 10 having, inserted therein, the pressurizing tube 11 expandable by air pressure (or hydraulic pressure), without the heat-shrinkable tape 12 placed around the outer peripheral surface of the outer molding member 9, is placed in the bat forming metallic mold 13, a knob 2*d* formed of FRP is attached to the bat molding member 10, and the metallic mold 13 is closed.

Then, the pressurizing tube 11 is expanded, and the bat molding member 10 is heated in a state of the pressurizing tube 11 pressing the inner molding member 8 against the inner peripheral surface 4*a* of the joined end region 4 of the ball-hitting member 1 and the inner peripheral surface of the metallic mold 13.

The other aspects are the same as those described in the first embodiment, and therefore like numerals are affixed to like parts which are the same as in the first embodiment and will not be described again.

Third Embodiment

Figure 8:
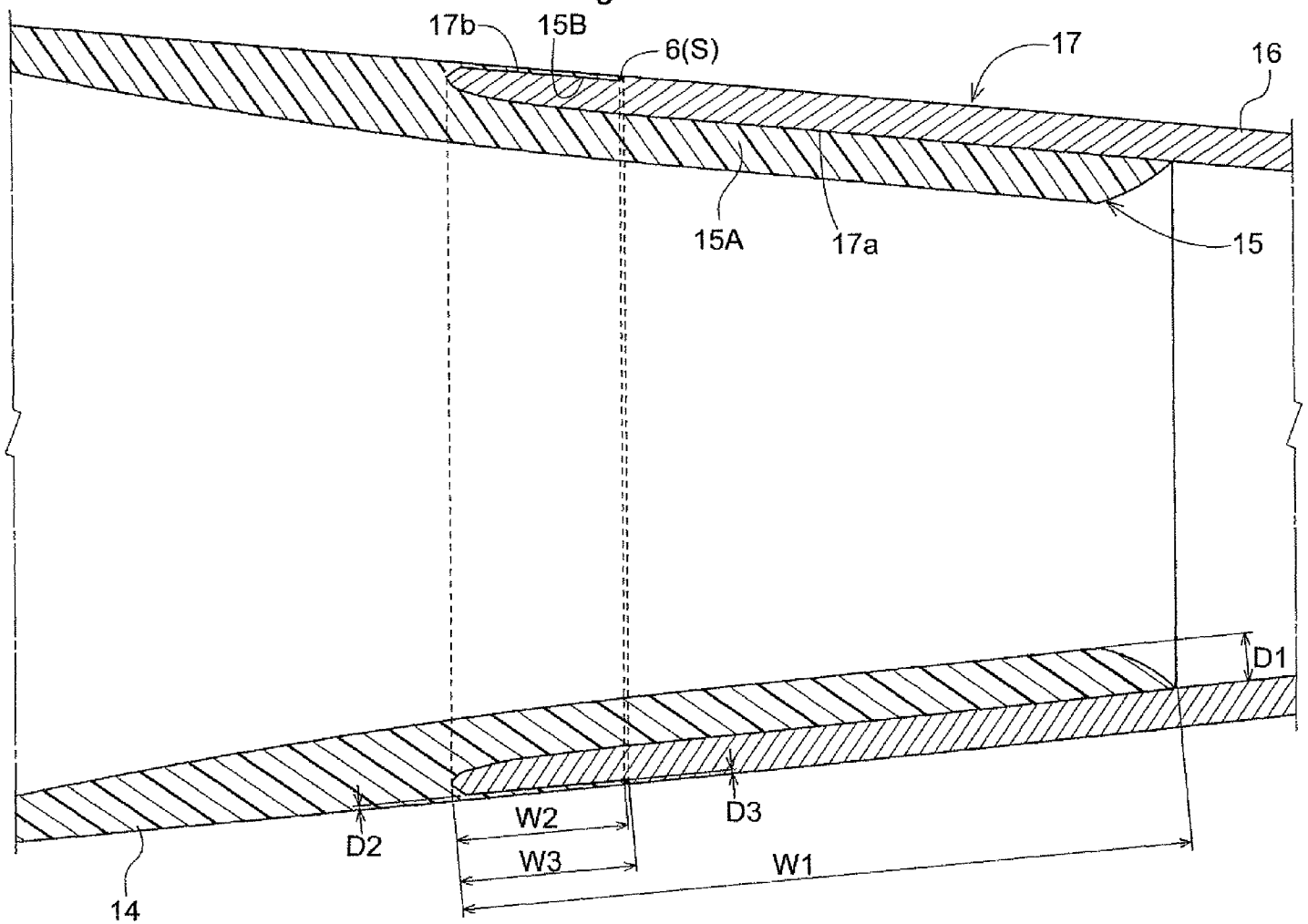
FIG. 8 is a sectional side view of a principal part in a third embodiment of baseball or softball bat.

In each of the foregoing embodiments, the joining end region 5 of the grip member 2 made of FRP has, formed integral therewith, the adhering piece 5A bonded to the inner peripheral surface 4*a* of the joined end region 4 of the ball-hitting member 1 made of metal, and the contact piece 5B for contacting the outer peripheral surface 4*b* of the joined end region 4 of the ball-hitting member 1 when the adhering piece 5A is in the bonded state. Instead, as shown in FIG. 8, a joining end region 15 of a ball-hitting member 14 made of FRP may have, formed integral therewith, an adhering piece 15A bonded to an inner peripheral surface 17*a* of a joined end region 17 of a grip member 16 made of metal, and a contact piece 15B for contacting an outer peripheral surface 17*b* of the joined end region 17 of the grip member 16 when the adhering piece 15A is in a bonded state.

The specific construction of the joining end region 15 of the FRP ball-hitting member 14 is the same as that of the joining end region 5 of the FRP grip member 2 described in the first embodiment, and its description will be omitted. The specific construction of the joined end region 17 of the metal grip member 16 is the same as that of the joined end region 4 of the metal ball-hitting member 1 described in the first embodiment, and its description will be omitted.

Fourth Embodiment

As an improvement of the baseball or softball bats T shown in the first and second embodiments described above, a cylindrical ball-hitting tube 18 made of FRP may be fitted in the ball-hitting member 1.

Figure 9:
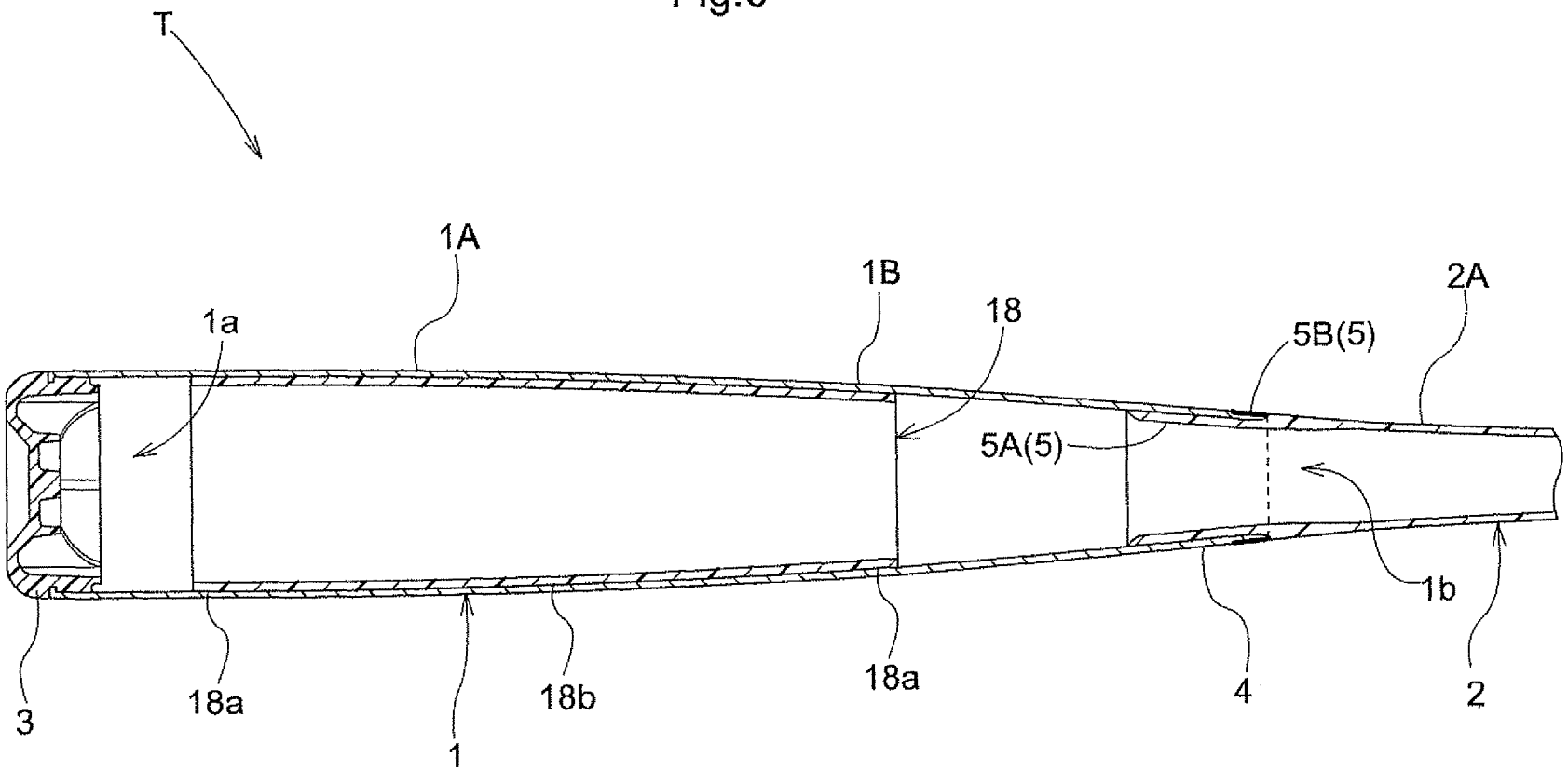
FIG. 9 is a sectional side view of a principal part in a fourth embodiment of baseball or softball bat.

As shown in FIG. 9, the ball-hitting tube 18 is placed in an intermediate part, in the longitudinal direction of the bat, of the ball-hitting member 1 in a state of circumferential contact with the inner peripheral surface of the ball-hitting member 1. Opposite end regions 18*a* of the ball-hitting tube 18 are bonded to the inner peripheral surface of the ball-hitting member 1. On the other hand, an intermediate part 18*b*, in the longitudinal direction of the bat, of the ball-hitting tube 18 is not bonded to the inner peripheral surface of the ball-hitting member 1.

Thus, the intermediate part 18*b*, in the longitudinal direction of the bat, of the ball-hitting tube 18 can elastically deform independently of the ball-hitting member 1. Therefore, this baseball or softball bat T, with elastic deformation of each of the ball-hitting member 1 and ball-hitting tube 18 can apply repulsion to balls, thereby improving the ball driving distance.

Next, a method of manufacturing the baseball or softball bat T having the above construction will be described. The steps of forming the ball-hitting member 1 and inner molding member 8 are the same as those described in the first embodiment, and will not be described again.

(a) Forming a Tube Molding Member 19 to Serve as the Ball-Hitting Tube 18

Figure 10:
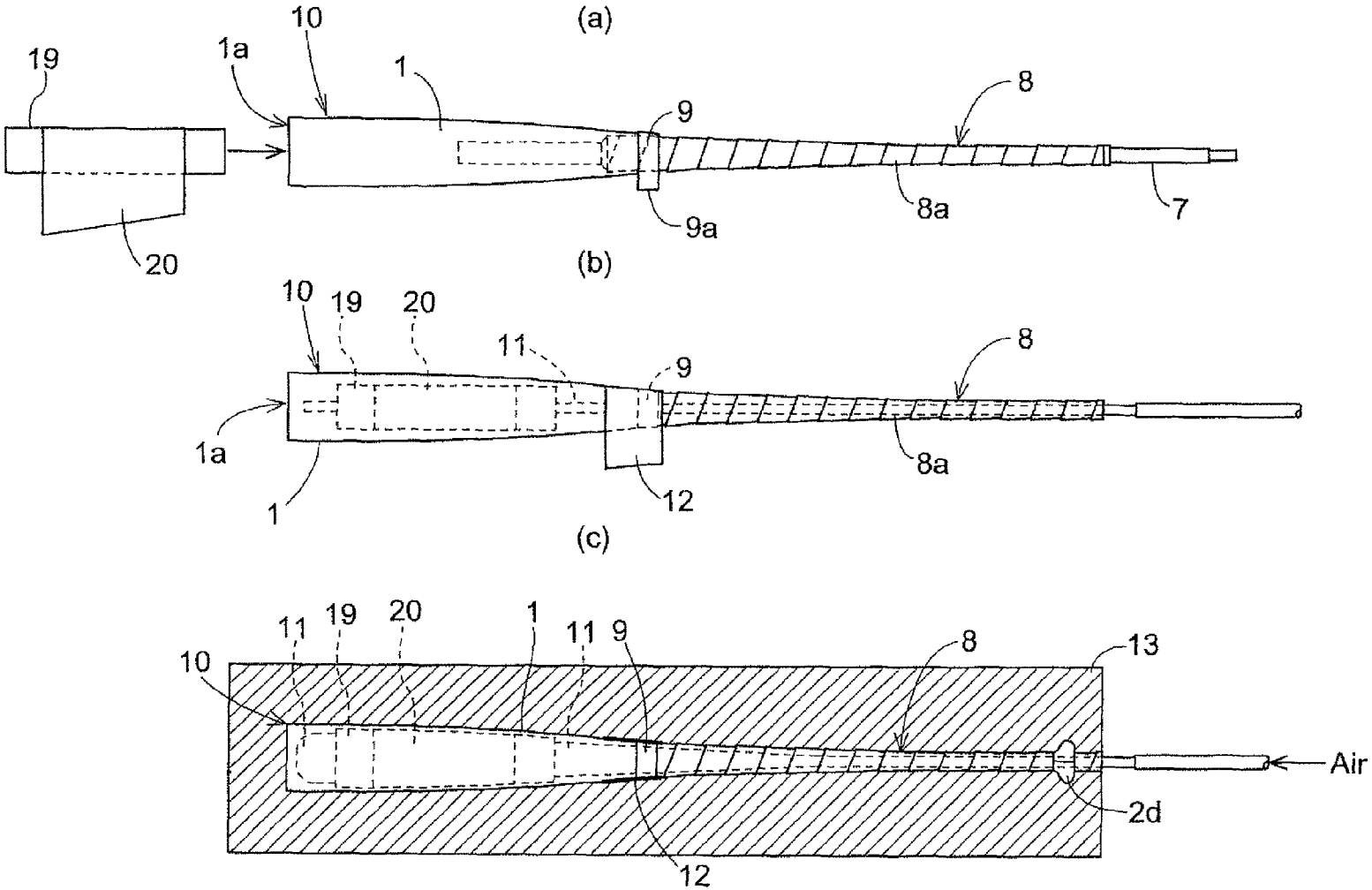
FIG. 10 is an explanatory view showing a manufacturing method in the fourth embodiment of baseball or softball bat.

Separately from the ball-hitting member 1 and inner molding member 8, a cylindrical tube molding member 19 is formed from a prepreg which becomes an FRP material when heated. Then, as shown in FIG. 10 (*a*), the adhesion aiding tape (not shown) is wrapped around opposite end regions, in the longitudinal direction of the bat, the outer peripheral surface of the tube molding member 10. An adhesion preventive sheet 20 (an example of adhesion preventive member) is wrapped around an intermediate region, in the longitudinal direction of the bat, of the outer peripheral surface of the tube molding member 19 for preventing adhesion of the tube molding member 19 and ball-hitting member 1. The adhesion preventive sheet 20 is in the form of a broad biaxially oriented polypropylene film.

(b) Assembling a Bat Molding Member 10

As in the first embodiment described above, the adhesion aiding tape (not shown) is wrapped around the part to be attached to the ball-hitting member 1 of the outer peripheral surface of the inner molding member 8. Subsequently, the inner molding member 8 is inserted into the ball-hitting member 1 from the distal end opening 1*a* of the ball-hitting member 1, in a state of drawing a part of the inner molding member 8 adjacent the proximal end of the bat out of the proximal end opening 1*b* of the ball-hitting member 1. The inner molding member 8 and ball-hitting member 1 are arranged in a predetermined relative position as shown in FIG. 10 (*a*).

Next, an adhesion aiding tape similar to the one noted above is wrapped around the outer peripheral surfaces of the inner molding member 8 and ball-hitting member 1, in a state of covering the boundary between the inner molding member 8 and ball-hitting member 1. Subsequently, as shown in FIG. 10 (*a*), an FRP sheet 9*a* is wrapped around the outer peripheral surface of the adhesion aiding tape to form an outer molding member 9 serving as the grip member 2. The tube molding member 10 is inserted into the ball-hitting member 1 from the distal end opening 1*a* of ball-hitting member 1, and is placed in an intermediate part, in the longitudinal direction of the bat, of the ball-hitting member 1. The above steps complete assembly of the bat molding member 10.

(c) Forming the Bat T

As shown in FIG. 10 (*b*), a pressurizing tube 11 expandable by air pressure (or hydraulic pressure) is inserted in replacement of the mandrel 7 into the bat molding member 10 assembled in step (b) above. A heat-shrinkable tape 12 having heat shrinkability (an example of radially shrinkable member radially shrinkable when heated) is wrapped around the outer peripheral surface of the outer molding member 9.

Next, as shown in FIG. 10 (*c*), the bat molding member 10 with the pressurizing tube 11 and heat-shrinkable tape 12 attached thereto is placed in a bat forming metallic mold 13, a knob 14 formed of FRP is attached, and the metallic mold 13 is closed. Then, the pressurizing tube 11 is expanded, and the bat molding member 10 is heated in a state of the pressurizing tube 11, with its expansion pressure, pressing the inner molding member 8 against the inner peripheral surface 4*a* of the joined end region 4 of the ball-hitting member 1 and the inner peripheral surface of the metallic mold 13, and in a state of pressing the tube molding member 19 against the inner peripheral surface of the ball-hitting member 1.

Then, the bat molding member 10 formed integral by heating is taken out of the metallic mold 13. The outer peripheral surface of the bat molding member 10 is put to finishing processes such as polish, putty process, printing and painting. Subsequently, a step of attaching the end cap 3 and a step of wrapping leather around the grip portion 2B to complete formation of the bat T.

The other aspects are the same as those described in the first embodiment, and therefore like numerals are affixed to like parts which are the same as in the first embodiment and will not be described again.

Other Embodiments

Next, other embodiments will be listed.

The first, second and fourth embodiments described above show the example where the joining end region 5 of the grip member 2 formed of FRP has, formed integral therewith, the adhering piece 5A bonded to the inner peripheral surface 4*a* of the joined end region 4 of the ball-hitting member 1 formed of metal, and the contact piece 5B for contacting the outer peripheral surface 4*b* of the joined end region 4 of the ball-hitting member 1 when the adhering piece 5A is in the bonded state. Instead, the joining end region 5 of the grip member 2 may have, formed integral therewith, an adhering piece bonded to the outer peripheral surface 4*b* of the joined end region 4 of the ball-hitting member 1, and a contact piece for contacting the inner peripheral surface 4*a* of the joined end region 4 of the ball-hitting member 1 when the adhering piece is in the bonded state.

Similarly, the third embodiment described above shows the example where the joining end region 15 of the ball-hitting member 14 formed of FRP has, formed integral therewith, the adhering piece 15A bonded to the inner peripheral surface 17*a* of the joined end region 17 of the grip member 16 formed of metal, and the contact piece 15B for contacting the outer peripheral surface 17*b* of the joined end region 17 of the grip member 16 when the adhering piece 15A is in the bonded state. Instead, the joining end region 15 of the ball-hitting member 14 formed of FRP may have, formed integral therewith, the adhering piece 15A bonded to the outer peripheral surface 17*b* of the joined end region 17 of the grip member 16 formed of metal, and the contact piece 15B for contacting the inner peripheral surface 17*a* of the joined end region 17 of the grip member 16 when the adhering piece 15A is in the bonded state.

The first, second and fourth embodiments described above show the example where the contact piece 5B of the grip member 2 also is bonded to the joined end region 4 of the ball-hitting member 1. This bonding is not absolutely necessary.

Similarly, the third embodiment described above shows the example where the contact piece 15B of the ball-hitting member 14 also is bonded to the joined end region 17 of the grip member 16. This bonding is not absolutely necessary.

The specific construction such as the configuration of the joined end regions 4 and 17 and the specific construction such as the configuration of the joining end regions 5 and 15 are not limited to the construction shown in each embodiment described above, but may be varied in many ways.

The second embodiment described above shows the example where the expandable member expandable by heating is placed beforehand in the position opposed to the outer molding member 9 in the bat forming metallic mold 13. For example, the expandable member may be pinched by the outer peripheral surface of the outer molding member 9 and the inner peripheral surface of the bat forming metallic mold 13.

The second embodiment described above shows the expandable member expandable by heating as an example of second pressing device for pressing the outer molding member 9 against the outer peripheral surface of the ball-hitting member 1. For example, this may be an expandable member expandable by air pressure or liquid pressure, or a pressing member powered to press the outer molding member 9 against the outer peripheral surface of the ball-hitting member 1.

The first and fourth embodiments described above show the heat-shrinkable tape 12 as an example of radially shrinkable member radially shrinkable when heated. This is not limitative, but an annular member, for example, may be employed as long as it is radially shrinkable when heated.

The second embodiment described shows the silicon rubber pad 18 as an example of expandable member expandable by heating. This is not limitative, but various members may be employed as long as they are expandable by heating.

The first, second and fourth embodiments described above show the pressurizing tube 11 expandable by air pressure or liquid pressure as an example of first pressing device for pressing the inner molding member 8 against the inner peripheral surface of the ball-hitting member 1. This is not limitative, but it may be a pressing member powered to press the inner peripheral surface of the inner molding member 8 against the outer peripheral surface of the ball-hitting member 1.

The specific construction of the receiving portion 4*e* for the contact piece is not limited to the construction shown in each embodiment described above, but may be varied in many ways.

The embodiments described above show the example where the prepreg 8*a* in tape form is wrapped in laminated state around the mandrel 7 to form the inner molding member 8. For example, a plurality of strip-like prepregs 8*a* may be wrapped in laminated state to form the inner molding member 8.

The first and second embodiments show the example where the boundary 4*c* serving as the shift starting point on the inner peripheral surface 4*a* of the ball-hitting member 1 is formed to have a smooth curved surface shape. It may have various shapes such as a bent surface shape having an angled part or a corrugated surface shape having level differences.

The fourth embodiment described above shows the example where the adhesion preventive member is wrapped beforehand around the intermediate region, in the longitudinal direction of the bat, of the outer peripheral surface of the tube molding member 10 for preventing adhesion of the tube molding member 19 and ball-hitting member 1. Instead, when inserting the tube molding member 19 into the ball-hitting member 1, a solid adhesion preventive member may be interposed between the outer peripheral surface of the tube molding member 19 and the inner peripheral surface of the ball-hitting member 1. Further, for example, an adhesion inhibitor (e.g. lubricant) for preventing adhesion of the tube molding member 19 and ball-hitting member 1 may be applied to one or both of the outer peripheral surface of the tube molding member 19 and the inner peripheral surface of the ball-hitting member 1.

The fourth embodiment described above shows the biaxially oriented polypropylene film as an example of the adhesion preventive member for preventing adhesion of the tube molding member 19 and ball-hitting member 1. Various articles may be used as long as they do not melt when heated by the metallic mold 13, such as commercially available food packing wrap film made from polyvinylidene chloride, silicon rubber sheet, and so on.

A member having heat expandability, elasticity or both (e.g. a member made from an elastomeric material such as silicon rubber sheet) may be interposed as or in addition to the adhesion preventive member between the tube molding member 19 and ball-hitting member 1. Then, when the metallic ball-hitting member 1 contracts by cooling from an expanded state at a time of hot forming, the above construction can inhibit the construction of the ball-hitting member 1 applying a compressive force to the FRP ball-hitting tube 18 at a time of product completion. This can further promote the independence of the ball-hitting tube 18 and ball-hitting member 1. Therefore, the effect of improving ball repulsion due to the elastic deformation of each of the ball-hitting member 1 and ball-hitting tube 18 can be obtained more effectively.

The fourth embodiment described above shows the example where the pressurizing tube 11 and mandrel 7 are interchanged after the tube molding member 10 is inserted into the ball-hitting member 1. The pressurizing tube 11 and mandrel 7 may be interchanged before the tube molding member 10 is inserted into the ball-hitting member 1.

Each embodiment described above shows the example of using the pressurizing tube 11 of the type that air is introduced from the proximal end of the bat. It is possible to use a pressurizing tube of the type that air is introduced from the distal end of the bat.

This invention is not limited to baseball or softball bats, but is applicable to bats for similar ball games and a manufacture method thereof.

The invention claimed is:

1. A baseball or softball bat constructed by joining a ball-hitting member made of metal and a grip member made of Fiberglass Reinforced Plastic (FRP), wherein a joining end region of the grip member has, formed integral therewith, an adhering piece bonded to one of an inner peripheral surface and an outer peripheral surface of a joined end region of the ball-hitting member, and a contact piece for contacting the other of the inner peripheral surface and the outer peripheral surface of the joined end region of the ball-hitting member when the adhering piece is in a bonded state;

wherein the adhering piece is bonded to the inner peripheral surface of the joined end region of the ball-hitting member; and wherein the joined end region of the ball-hitting member is formed progressively thinner toward a proximal end of the bat to a terminal portion of the joined end region, in such a manner that the inner peripheral surface shifts toward the outer peripheral surface as it extends toward the proximal end of the bat.

2. A baseball or softball bat constructed by joining a ball-hitting member made of metal and a grip member made of Fiberglass Reinforced Plastic (FRP), wherein a joining end region of the grip member has, formed integral therewith, an adhering piece bonded to one of an inner peripheral surface and an outer peripheral surface of a joined end region of the ball-hitting member, and a contact piece for contacting the other of the inner peripheral surface and the outer peripheral surface of the joined end region of the ball-hitting member when the adhering piece is in a bonded state;

wherein the adhering piece is bonded to the inner peripheral surface of the joined end region of the ball-hitting member;

wherein the joined end region of the ball-hitting member has an end surface a terminal end thereof formed to have a sloping surface shape, with the more radially outward position thereof located closer to a distal end of the bat; and wherein a proximal part of the contact piece adjacent to the proximal end of the bat and corresponding to the end surface of the joined end region of the ball-hitting member is made progressively thicker towards the proximal end of the bat.

3. The baseball or softball bat according to claim 2, wherein the contact piece is bonded to the outer peripheral surface of the joined end region of the ball-hitting member.

4. The baseball or softball bat according to claim 2, wherein the contact piece is formed to have a thickness of 0.1 mm to 1.0 mm.

5. A method of manufacturing a baseball or softball bat according to claim 3 comprising:

inserting a ball-hitting tube made of Fiberglass Reinforced Plastic (FRP) into the ball-hitting member, assembling a bat molding member by placing the joined end region of the ball-hitting member between an inner molding member and an outer molding member which form the grip member when heated, and placing in the ball-hitting member a tube molding member for forming the ball-hitting tube when heated, and subsequently heating the bat molding member with a bat forming metallic mold in a state in which a first pressing device presses the inner molding member and the tube molding member against the inner peripheral surface of the ball-hitting member, and in a state in which a second pressing device presses the outer molding member against the outer peripheral surface of the ball-hitting member.

6. The method of manufacturing the baseball or softball bat according to claim 5, wherein, before heating the bat molding member with the metallic mold, an adhesion preventive member is interposed between the tube molding member and the ball-hitting member for preventing adhesion of the tube molding member and the ball-hitting member, or an adhesion inhibitor is applied to an outer peripheral surface of the tube molding member or an inner peripheral surface of the ball-hitting member.

7. A baseball or softball bat constructed by joining a ball-hitting member made of metal and a grip member made of Fiberglass Reinforced Plastic (FRP), wherein a joining end region of the grip member has, formed integral therewith, an adhering piece bonded to one of an inner peripheral surface and an outer peripheral surface of a joined end region of the ball-hitting member, and a contact piece for contacting the other of the inner peripheral surface and the outer peripheral surface of the joined end region of the ball-hitting member when the adhering piece is in a bonded state;

wherein the adhering piece is bonded to the inner peripheral surface of the joined end region of the ball-hitting member;

wherein the joined end region of the ball-hitting member has, formed thereon, a receiving portion for the contact piece where the outer peripheral surface is reduced radially inwardly of the bat; and wherein the receiving portion for the contact piece is configured to have a width corresponding to a thickness of the contact piece in a radial direction of the bat and a length corresponding to a length of the contact piece in a longitudinal direction, in such a manner that no step is formed in a transition portion between the joining end region of the grip member and the joined end region of the ball-hitting member.

8. The baseball or softball bat according to claim 7, wherein the receiving portion is arranged to form a space from an end surface of the contact piece when the bat is in a joined state.

9. A method of manufacturing the baseball or softball bat constructed by joining a ball hitting member made of metal and a grip member made of Fiberglass Reinforced Plastic (FRP), comprising the steps of:

providing a first pressing device on an inside of the inner peripheral surface of the ball-hitting member, providing a second pressing device on an outside of the outer peripheral surface of the ball-hitting member, providing a bat forming metallic mold configured for receiving the ball-hitting member and the grip member, assembling a bat molding member by placing a joined end region of the ball-hitting member between an inner molding member and an outer molding member which form the grip member when heated, placing the bat molding member inside the bat forming metallic mold, and heating the bat molding member inside a bat forming metallic mold in a state in which a first pressing device presses the inner molding member against the inner peripheral surface of the ball-hitting member, and in a state in which a second pressing device presses the outer molding member against the outer peripheral surface of the ball-hitting member;

wherein a joining end region of the grip member has, formed integral therewith, an adhering piece bonded to one of an inner peripheral surface and an outer peripheral surface of a joined end region of the ball-hitting member, and a contact piece for contacting the other of the inner peripheral surface and the outer peripheral surface of the joined end region of the ball-hitting member when the adhering piece is in a bonded state;

wherein the contact piece is bonded to the outer peripheral surface of the joined end region of the ball-hitting member.

10. The method of manufacturing the baseball or softball bat according to claim 9, wherein an expandable member expandable by heating is placed as the second pressing member between the outer molding member and the bat forming metallic mold.

11. The method of manufacturing the baseball or softball bat according to claim 9, wherein a radially shrinkable member radially shrinkable by heating is placed around the outer molding member.

12. The method of manufacturing the baseball or softball bat according to claim 10, wherein the expandable member is placed beforehand on a part of the bat forming metallic mold opposed to the outer molding member.

13. A baseball or softball bat constructed by joining a ball-hitting member made of Fiberglass Reinforced Plastic (FRP) and a grip member made of metal, wherein a joining end region of the ball-hitting member has, formed integral therewith, an adhering piece bonded to one of an inner peripheral surface and an outer peripheral surface of a joined end region of the grip member, and a contact portion for contacting the other of the inner peripheral surface and the outer peripheral surface of the joined end region of the grip member when the adhering piece is in a bonded state;

wherein the adhering piece is bonded to the inner peripheral surface of the joined end region of the grip member; and wherein the joined end region of the grip member is formed progressively thinner toward a distal end of the bat to a terminal portion of the joined end region, in such a manner that the inner peripheral surface shifts toward the outer peripheral surface as it extends toward the distal end of the bat.

14. A baseball or softball bat constructed by joining a ball-hitting member made of Fiberglass Reinforced Plastic (FRP) and a grip member made of metal, wherein a joining end region of the ball-hitting member has, formed integral therewith, an adhering piece bonded to one of an inner peripheral surface and an outer peripheral surface of a joined end region of the grip member, and a contact portion for contacting the other of the inner peripheral surface and the outer peripheral surface of the joined end region of the grip member when the adhering piece is in a bonded state;

wherein the adhering piece is bonded to the inner peripheral surface of the joined end region of the grip member;

wherein the joined end region of the grip member has an end surface thereof formed to have a sloping surface shape, with the more radially outward position thereof located closer to a proximal end of the bat; and wherein a distal part of the contact piece adjacent to the distal end of the bat and corresponding to the end surface of the joined end region of the grip member is made progressively thicker towards the distal end of the bat.

15. A baseball or softball bat constructed by joining a ball-hitting member made of Fiberglass Reinforced Plastic (FRP) and a grip member made of metal, wherein a joining end region of the ball-hitting member has, formed integral therewith, an adhering piece bonded to one of an inner peripheral surface and an outer peripheral surface of a joined end region of the grip member, and a contact portion for contacting the other of the inner peripheral surface and the outer peripheral surface of the joined end region of the grip member when the adhering piece is in a bonded state;

wherein the adhering piece is bonded to the inner peripheral surface of the joined end region of the grip member;

wherein the joined end region of the grip member has, formed thereon, a receiving portion for the contact piece where the outer peripheral surface is reduced radially inwardly of the bat; and wherein the receiving portion for the contact piece is configured to have a width corresponding to a thickness of the contact piece in a radial direction of the bat and a length corresponding to a length of the contact piece in a longitudinal direction, in such a manner that no step is formed in the outer periphery of the joining region.

* * * * *

UNITED STATES PATENT AND TRADEMARK OFFICE

CERTIFICATE OF CORRECTION

PATENT NO. : 8,197,365 B2
APPLICATION NO. : 12/524644
DATED : June 12, 2012
INVENTOR(S) : Kenichi Tokieda It is certified that error appears in the above-identified patent and that said Letters Patent is hereby corrected as shown below:

Column 15, Line 56, Claim 2, after “has” delete “an end surface”

Column 16, Line 61, Claim 9, delete “ball hitting” and insert -- ball-hitting --

Signed and Sealed this
Twenty-fifth Day of September, 2012

David J. Kappos

David J. Kappos
*Director of the United States Patent and Trademark Office*